US008316610B2

(12) United States Patent
Adams

(10) Patent No.: US 8,316,610 B2
(45) Date of Patent: Nov. 27, 2012

(54) BULK LIQUID AND MATERIAL DELIVERY DEVICE AND CONSTRUCTION BLOCK

(76) Inventor: Wendell B. Adams, Orlando, FL (US)

( * ) Notice: Subject to any disclaimer, the term of this patent is extended or adjusted under 35 U.S.C. 154(b) by 151 days.

(21) Appl. No.: 12/481,383

(22) Filed: Jun. 9, 2009

(65) Prior Publication Data

US 2010/0307095 A1 Dec. 9, 2010

(51) Int. Cl.
*E04C 1/00* (2006.01)

(52) U.S. Cl. ..... 52/603; 52/284; 52/568; 52/605

(58) Field of Classification Search ..... 52/605, 52/603, 606, 561, 563, 565, 284, 607, 562, 52/564, 568; 206/504, 509
See application file for complete search history.

(56) References Cited

U.S. PATENT DOCUMENTS

| | | | | |
|---|---|---|---|---|
| 3,194,426 | A | 7/1965 | Brown, Jr. | |
| 3,391,824 | A | 7/1968 | Wiseman | |
| 3,474,843 | A | 10/1969 | Maris | |
| 3,994,408 | A | 11/1976 | Belitzky | |
| 4,110,949 | A | 9/1978 | Cambiuzzi et al. | |
| 4,624,383 | A | 11/1986 | Moore | |
| 5,493,816 | A | 2/1996 | Willemsen | |
| 5,582,801 | A * | 12/1996 | DeWitt et al. | 422/131 |
| 5,740,637 | A * | 4/1998 | Snow | 52/136 |
| 5,832,687 | A * | 11/1998 | Willemsen | 52/592.6 |
| 6,088,987 | A * | 7/2000 | Simmons et al. | 52/592.6 |
| 6,161,357 | A * | 12/2000 | Altemus | 52/592.6 |
| 6,233,897 | B1 * | 5/2001 | Jurik | 52/604 |
| 6,276,549 | B1 | 8/2001 | Fasci et al. | |
| 6,571,525 | B2 * | 6/2003 | Coleman | 52/592.5 |
| 6,585,090 | B2 * | 7/2003 | Harvey | 190/108 |
| 6,663,323 | B1 * | 12/2003 | Boys | 405/284 |
| 6,889,479 | B2 * | 5/2005 | Thorpe | 52/596 |
| 6,948,282 | B2 * | 9/2005 | Bott | 52/98 |
| 7,140,493 | B2 * | 11/2006 | Fry | 206/509 |
| 7,546,712 | B2 * | 6/2009 | Shaw | 52/223.8 |
| 7,699,171 | B2 * | 4/2010 | Rivera et al. | 206/508 |
| 7,712,281 | B2 * | 5/2010 | Bott | 52/604 |
| 2003/0074856 | A1 * | 4/2003 | Hammer | 52/604 |
| 2005/0023174 | A1 * | 2/2005 | Lary et al. | 206/509 |
| 2005/0178081 | A1 * | 8/2005 | Bott | 52/596 |
| 2005/0257481 | A1 * | 11/2005 | Shaw | 52/606 |
| 2006/0254947 | A1 | 11/2006 | Rogers | |
| 2007/0154265 | A1 * | 7/2007 | Stauffacher et al. | 405/110 |
| 2008/0184649 | A1 * | 8/2008 | Khan | 52/592.6 |
| 2008/0298902 | A1 * | 12/2008 | Knudson et al. | 405/286 |
| 2009/0077920 | A1 * | 3/2009 | Korman et al. | 52/606 |
| 2009/0126280 | A1 * | 5/2009 | Radi et al. | 52/2.11 |
| 2009/0217610 | A1 * | 9/2009 | Curtis | 52/309.12 |

* cited by examiner

*Primary Examiner* — William Gilbert
*Assistant Examiner* — Alp Akbasli
(74) *Attorney, Agent, or Firm* — McHale & Slavin, P.A.

(57) ABSTRACT

A plastic construction block for storage of water, food, medicine, staples, construction materials, or any other item that needs to be contained for storage and shipping. The construction block can also be used in the construction of a bunker, wall, or the like structure through conventional building construction by filling of the block with sand or dirt. The construction block is substantially rectangular in shape having an enlarged fill port on one end with a resealable cap. The interior of the block is hollow and sized to hold about 3.4 fluid gallons. Apertures extend through the block and are used for receipt of anchoring posts. Each aperture further having a raised protrusion formed integral along one surface and a receptacle placed around each aperture on the rear surface. The raised protrusion interlocking with a receptacle on a rear surface of an adjoining construction block for aligning similar shaped construction blocks. The construction block further including at least one anchoring pipe retaining socket, said pipe retaining socket having a depth of approximately one half the diameter of an anchoring pipe allowing retention for use in storage and shipping.

12 Claims, 5 Drawing Sheets

BULK LIQUID AND MATERIAL DELIVERY DEVICE AND CONSTRUCTION BLOCK

FIELD OF THE INVENTION

This invention is related to portable containers and more particularly to a container for use in storage and shipping of various supplies and upon use of the supplies, reuse of the container as a construction block.

BACKGROUND OF THE INVENTION

Humans need water, food, medicine and shelter to survive, such basic items can be difficult to obtain in certain areas of the world or immediately after a natural or man-made disaster. A drought can result in the loss of potable water, a war can result in a lack of medicine, a hurricane can result in the loss of shelter, and so forth. While providing relief supplies to such areas is critical, it is even more critical to eliminate waste packaging as it can be prohibitively expensive to transport such supplies. In many instances, portable water is provided in containers, the containers are discarded after use. Conventional construction materials such as building blocks are very expensive to ship but necessary if a sound building structure is desired. Structures made of wood might be lighter for shipping but requires drywall, insulation, and siding to match the efficiency of the cement block thus making the shipping weight and costs about the same. In fact, there are numerous reasons why a conventional structure cannot be built in such a region including shipping costs, material costs, skilled labor costs and so forth. Further, in many instances there is an immediate need for shelter and waiting for construction materials, skilled labor or the right conditions can make the wait impractical. For instance, troops who establish a base camp in a hostile area do not have the luxury of having a conventional structure made for them. In such instances, troops will use anything at their disposal to create a shelter from the elements and hostiles.

For example, current areas of the world include hostiles making any attempt to dig a well, or shelter a life threatening event. In such instances, the troops may need to build a bunker for short term security. If the entire area is hostile, such as what the troops are encountering in Afghanistan, it is impossible to grow food or build any structure other than a basic tent enclosure. Such areas are completely dependant upon incoming supplies for all aspects of human survival. Hostile areas are not alone in the lack of water, food and building structures. Remote areas of the world suffering through food and water shortages, such as Mkuze, South Africa, also require water and construction materials to be brought in from other areas.

Further, emergency relief due to hurricane, flood, fire, drought or any other natural disaster results in the absolute lack of basic necessities. Recently, such events as Hurricane Katrina, the tornadoes and floods in the Midwest, the western states having a lack of water, or the eastern states having depressed economies such as West Virginia, all need water, food, medicine, staples, and construction materials delivered in time of need. Unfortunately, the shipping materials are typically discarded after use leading to environmental pollution.

It has been found that the use of containers can be used in various types of construction techniques from toys to small buildings. The teachings provide a concept but not a realistic solution. In reality, the shipping of the container filled with a material requires support although not in a similar manner to the use of the storage containers in a construction arrangement. For instance, in shipping of the containers the need for interlocking is important to prevent load shifting during transportation. However, once the container has arrived, the contents consumed, the shipping container may not make the preferred building block.

U.S. Pat. No. 3,194,426 is the earliest located patent that provides for interconnecting of containers. These interlocking containers do not provide for stacking and there is no ability to conceal or interlock the openings.

U.S. Pat. No. 3,391,824 discloses a method of stacking containers by nesting of the openings.

U.S. Pat. No. 3,994,408 discloses yet another container that allows for nesting wherein every other container is inverted to allow for interlocking. However, this device does not provide for construction stability.

U.S. Pat. No. 4,624,383 is the first patent located wherein the plastic containers are to be used as building blocks. This patent is now expired and free for the public to reuse. The patent is limited to a tongue and groove type attachment between the bottles and states that possible use in construction includes sheds.

U.S. Pat. No. 5,493,816 discloses a plastic container that can be filled with a fluid and used as a building block after the fluid is emptied from the container. This patent fails to disclose the use of reinforcing elements between the containers when employed as building blocks.

U.S. Pat. No. 6,276,549 issued in '2001 shows a method of using bottles both on a side by side relationship as well as for interconnecting end pieces.

Thus what is needed in the art is a container that can be utilized as a construction block for use in the building of bunkers, retention walls, small homes, and the like, structures for the protection of humans or their property.

SUMMARY OF THE INVENTION

Disclosed is a construction block formed from HDPE plastic that may be used for storage of water, food, medicine, staples, construction materials, or any other item that needs to be contained for storage and shipping. Upon removal of the stored items, the construction block can also be used as a building block in the construction of a bunker, wall, or the like building construction by filling of the block with sand or dirt. The construction block is substantially rectangular in shape having an enlarged fill port on one end and a resealable cap, the interior of the block is hollow and sized to hold about 3.4 gallons of fluid. Apertures extend through the block and are used for receipt of anchoring posts. Each aperture further having a raised protrusion formed integral along one surface and a receptacle placed abut each aperture on the rear surface. The raised protrusion interlocking with a receptacle on a rear surface of an adjoining construction block for aligning similar shaped construction blocks. The construction block further including at least one anchoring pipe retaining socket, the pipe retaining socket having a depth of approximately one half the diameter of an anchoring pipe allowing retention of an anchoring pipe for use in storage and shipping. The anchoring pipe in the storage position can also provide an interlocking between adjoining construction blocks while in the storage or shipping position.

An objective of the invention is to provide a hollow construction block constructed of FDA approved high density polyethylene resin (HDPE) that can be used for storing of water and reused as a construction block.

Another objective of the instant invention is to provide a container capable of holding approximately 13 liters (3.4 gallons) of liquid. The container being stackable in a number of configurations so as to prevent load shifting during transportation.

Yet another objective of the instant invention is to provide a construction block container that can be stacked and nested on a pallet, is receptive to shrink wrapping, and capable of being air dropped without rupturing of the container.

Still another object of the invention is to provide a construction block having a unique structure integrity that inhibits rupture from kinetic energy released when the container hits the ground from an air drop.

Yet another objective of the instant invention is to provide affordable, sustainable housing by use of the construction block that can operate as a shipping container.

Yet still another objective of the instant invention is to provide a container that can be converted to a solid construction by filling of the container with sand or dirt providing equal structural integrity of cement block.

Yet another objective of the instant invention is to provide a construction technique that allows recycling of containers used in transporting of liquids or solids wherein the containers can be immediately stacked so as to provide a bunker type protection or used in the recycle mode wherein the contents have been emptied from the container and the container refilled with dirt or sand to provide foundation and walls.

Yet still another objective of the instant invention is to provide a building block that can be easily filled with sand and stacked as an addition to or a replacement for conventional sandbags.

Still another objective of the instant invention is to disclose the use of anchoring sticks that can be shipped together with the building block or separately when support for taller walls is required.

Another objective of the instant invention is to provide a construction block that can be nested on a pallet, then shipped and/or airdropped quickly and economically.

Another objective of the invention is to provide a self contained construction block that can be used to construct permanent housing and other facilities in third world nations economically by eliminating the need for a foundation or the use of mortar.

Yet another objective of the instant invention is to provide a container capable of bulk water storage for a hurricane, storm preparedness, camping, boating, having a secondary use for construction to eliminate disposal.

Yet another objective of the instant invention is to provide an interlockable barrier that can be used as a temporary military command post, advanced military positions, bunkers or parapet walls. In such operations the containers could be filled with dirt or sand for use in creating a bunker wall.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE PREFERRED EMBODIMENT

Figure 1:
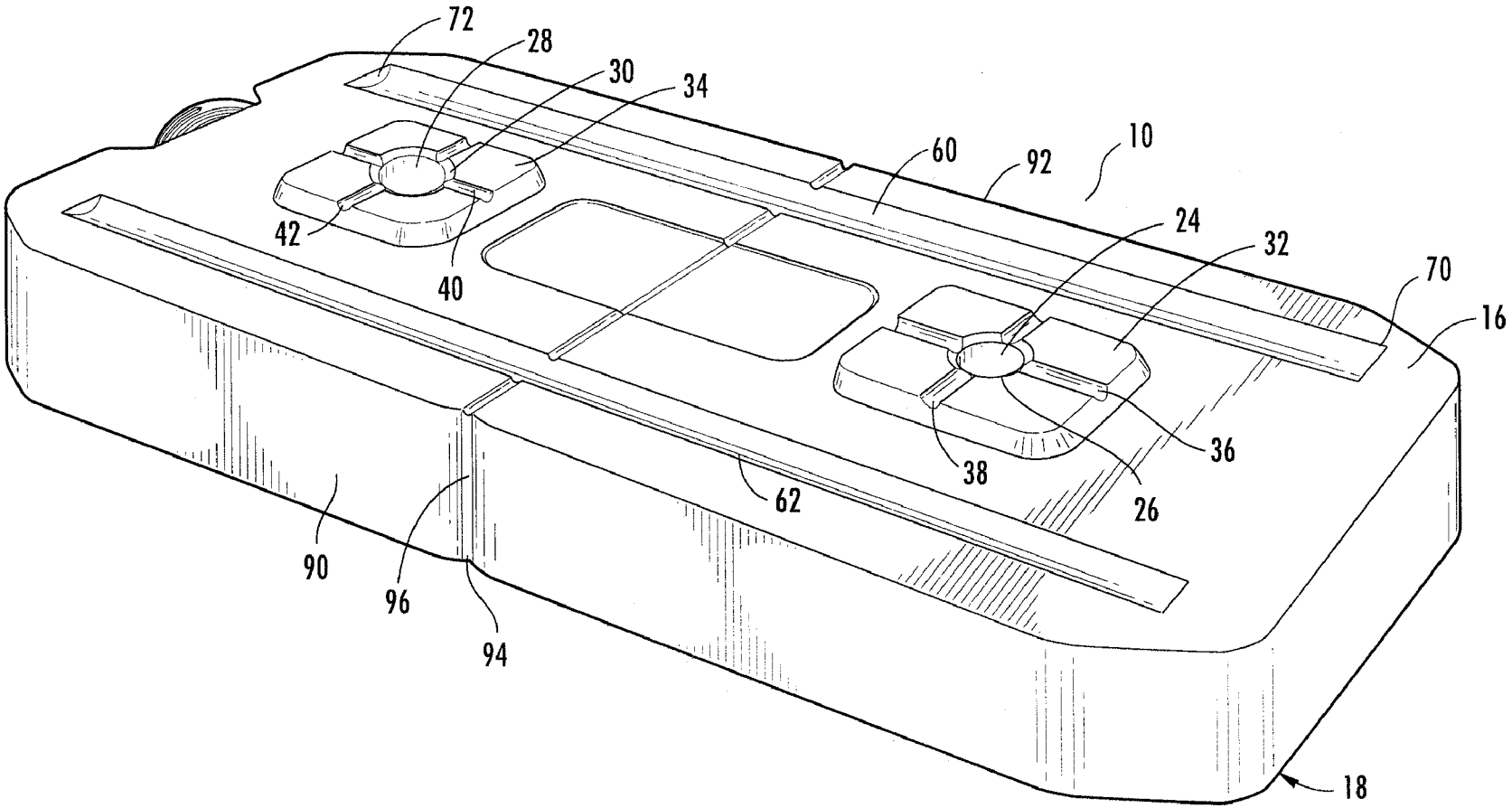
FIG. 1 is a perspective view of the construction block.
Figure 2:
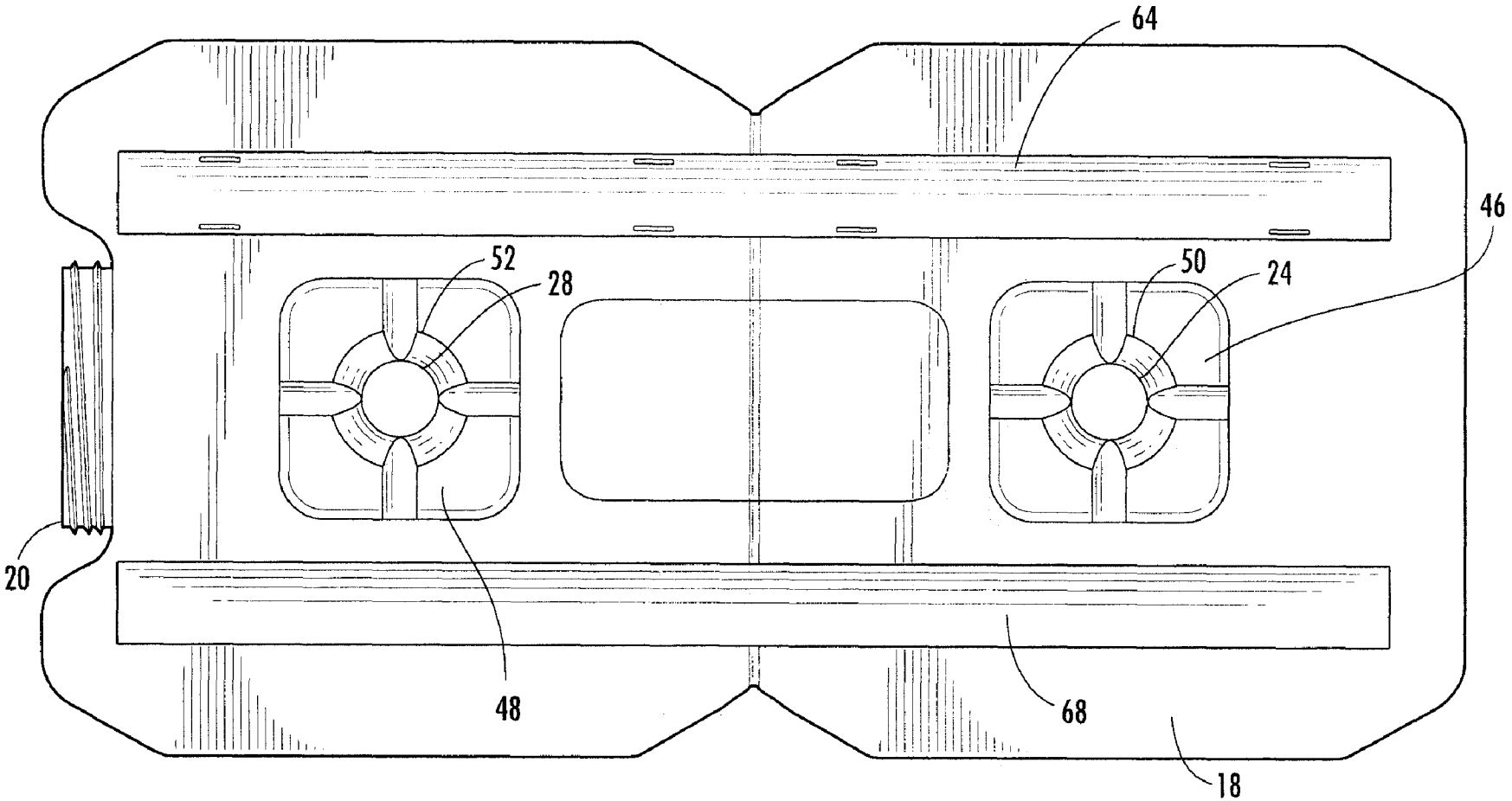
FIG. 2 is a bottom view of a construction block.
Figure 3:
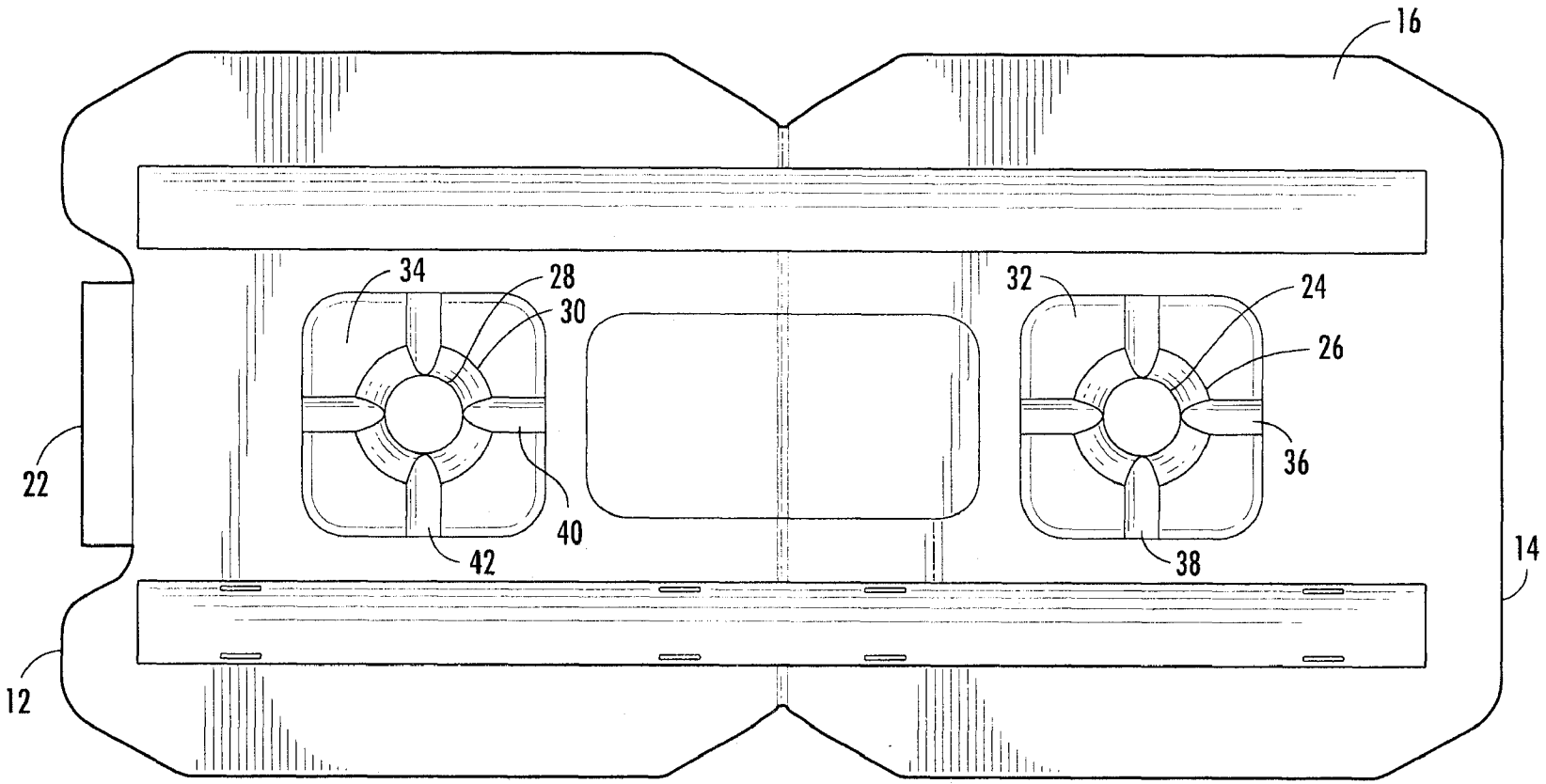
FIG. 3 is a top view of the construction block.

Now referring to the figures, set forth is the construction block (10) of the instant invention formed from a structure having a top surface (12), a bottom surface (14), a front surface (16) a rear surface (18), and opposing side walls (90 and 92). The top surface (12) includes a fill port (20) which is threaded and enclosed upon receipt of a threaded cap (22). The inside of the construction block is hollow, having a volume that will hold approximately 3.4 gallons of water. The preferred structure and cap material is a food grade quality, high density polyethylene (HDPE) plastic.

The inside of the construction block is available for storage of most any material but has a particular benefit when used to store water, food, medicine, or any other staple that needs to be shipped into remote areas. As will be explained, in this use the additional benefits of the construction block will be to reuse the structure in the construction of walls and eliminate the need for disposal. Unique to this construction block is the use of a first aperture (24) which extends from the front surface (16) to the rear surface (18). The aperture (24) includes a funnel shaped enlarged opening (26) along the front surface which is reduced down to a sized opening approximately halfway between the front surface and the rear surface so as to allow self aligning of a pipe or similar anchoring mechanism when adjoining construction blocks are placed together. For example, when similar construction blocks are stacked, the aperture is used for placement of an anchoring pipe between adjoining construction blocks or for extension into a foundation as a foundation anchor. So as to ease in the assembly, the construction block employs the funnel shaped opening as an alignment mechanism to provide ease of anchor stick insertion through a stack of construction blocks. A second aperture (28) is located along the other end of the construction block to provide a similarly shaped funnel opening (30) leading to a sized opening approximately halfway between the front surface and the rear surface. The preferred sized opening is to accommodate a three quarters of an inch diameter pipe or the like alignment mechanism.

The front surface (16) of the construction block further includes raised protrusions (32 and 34) which are formed integral with the structure and placed about the first and second aperture. In the preferred embodiment, the protrusions are square shaped, but the use of three, five, six or various other shapes may be used. The raised protrusion (32) includes grooves (36 and 38) which allows material displacement during installation as well as structural rigidity to the protrusions. Similarly, protrusion (34) includes grooves (40 and 42) again for ease of material displacement and rigidity. Protrusion (32) operates in conjunction with a receptacle (46) found on an adjoining container as does protrusion (34) operate with a receptacle (48) located on the rear surface (18). The protrusions are constructed and arranged interface with a receptacle on an adjoining construction block, where receptacle being in the same format as aforementioned receptacles (46 and 48). Receptacle (46) is shown illustrated with pass through aperture (24) and it further includes a funnel shaped opening (50). Similarly, receptacle (48) provides access to sized opening aperture (28) with a funnel shaped opening (52).

Each construction block includes at least one anchoring pipe retaining socket (60). The pipe retaining socket has a depth of one half the diameter of an anchoring pipe (80) and is used for maintaining the anchoring pipe during storage and shipping. In this embodiment, the construction block has a first anchoring pipe retaining socket (60) and a second anchoring pipe retaining socket (62) allowing placement of two PVC pipes or cross shaped stakes that are frictionally engaged into the retaining sockets to prevent dislodgement during shipping. It should be noted that the rear surface (18) has reciprocal retaining sockets (64 and 68) that allow an adjoining construction block to be aligned with the protrusion and receptacle arrangement but further provide a possible interlocking arrangement when the construction blocks are stacked for shipping. For instance, when two adjoining construction blocks are pressed together, the anchoring pipes are frictionally attached to each construction block thereby maintaining the construction block in a secure manner. Frictional fit can include a sufficient interference fit so as to require the construction blocks to be pried apart when an anchoring pipe is placed in the front receptacle engaging a rear receptacle. Alternatively, each end (70 and 72) can be sized to cause interference fit with the ends of an anchoring pipe to maintain the anchoring pipe in the groove yet not frictionally engage the side walls of the groove (60). In the alternative embodiment, an adjoining construction block may be placed in a stacked manner and the anchoring pipes would not frictionally engage each container, however an anchoring pipe placed in there would allow alignment of each container and would permit ease of removal without the need of prying apart adjoining construction blocks.

Figure 4:
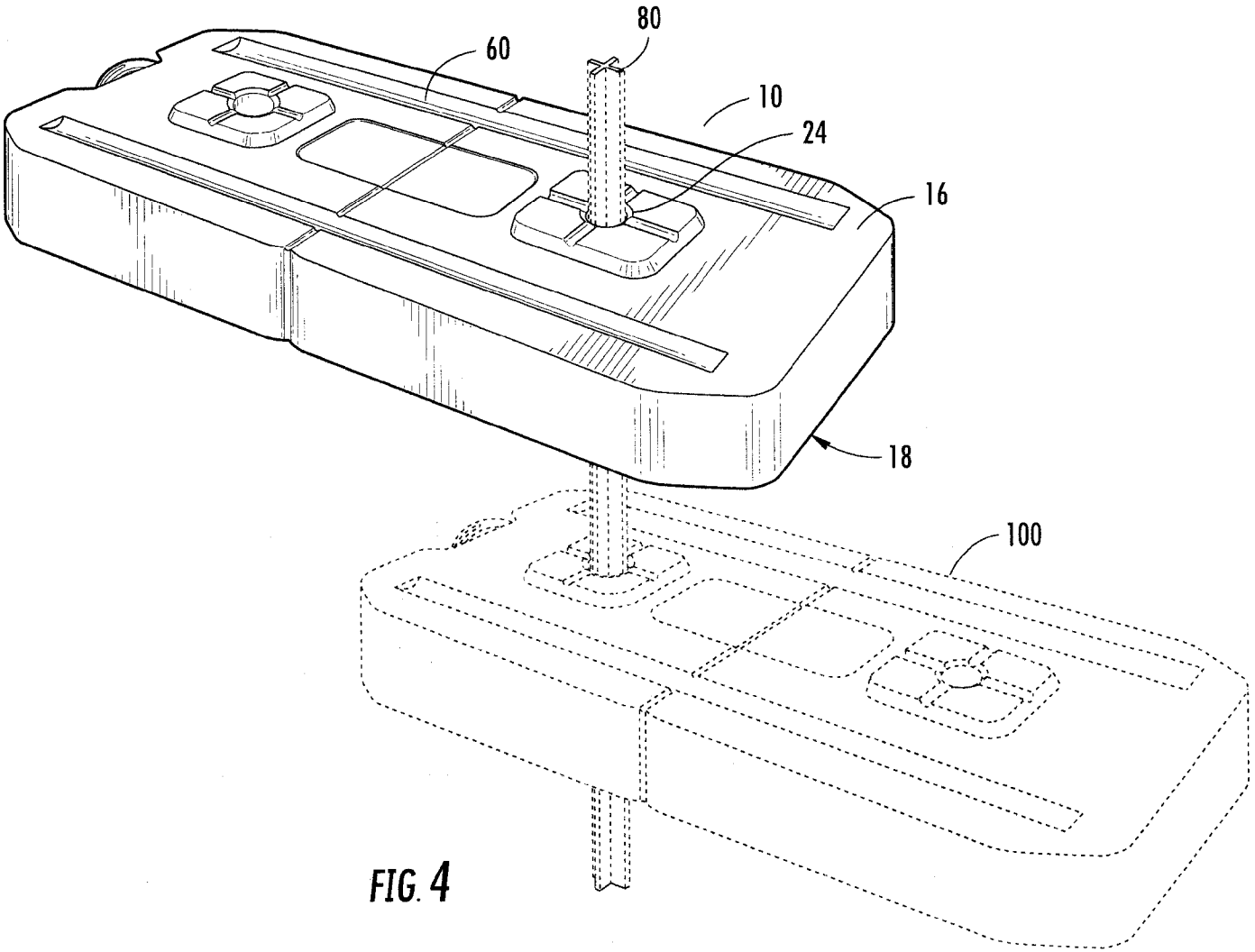
FIG. 4 is a perspective view of a construction block in conjunction with an adjoining construction block with an anchoring pipe being placed therebetween.

As shown in FIG. 4, the construction block (10) is illustrated in an exploded view being stacked with construction block (100) wherein a stake (80) which has been removed from groove (60) is placed through aperture (24) extending from the front surface (16) to the rear surface (18) for alignment to an adjoining construction block having a similar aperture. The illustration shows the blocks in an offset arrangement for stacking in a conventional brick and mortar block construction technique.

The construction block further includes an area to allow cutting of the block into equal halves, as necessary in construction. The first and second side surface (90 and 92) have a tapered detent (94) which allows ease of cutting the container in half. The detent is particularly useful when a hand saw is used in cutting of the block, the detent operating as an alignment guide. The detent leads to a cut line (96) that encompasses the block, the cut line providing a guide but allows use of a knife by reducing the wall thickness for ease of cutting.

To illustrate stability, tests have been made to show that when the construction block is filled with sand, a wall constructed of the construction blocks can carry a truss load with or without a top plate. If no top plate is used, the structure will be able to support a plant load of over 3,000 pounds with the deflection of about a one half inch and a permanent deflection of approximately three quarters of an inch. The wall construction can support trusses on approximately 2 foot centers spanning approximately 85 feet. This assumes a live load of 20 PSF with a dead load of 15 PSF. With a load deflection curve, it is noted that sand placed in the construction blocks loading by a truss in the same manner but spanning only 40 feet would deflect approximately a one half inch.

If a double 2×8 wood plate is placed on top of the structure, the construction block can support up to 5,800 pounds with a temporary deflection of about 2 inches and a permanent deflection of about 1.1 inches. Roof trusses are spaced at 4 feet on center and loaded with 20 PSF live load and PSF dead load to span up to 80 feet. This same loading on a truss spanning 40 feet would result in a deflection of about 1.15 inches. The testing has discovered that the construction block is able to support point loads from wood trusses for reasonable truss spans, with or without a wood top plate. The top plate is useful in spreading out the load and minimizing the corresponding deflection on the block. A second test was made on a structural property of the ability of the block to hold common drywall screws. It has been found that a drywall screw installed into any area into the top of the block with resist a minimum pullout of about 50 pounds, regardless of where it is installed in the top of the block.

Figure 5:
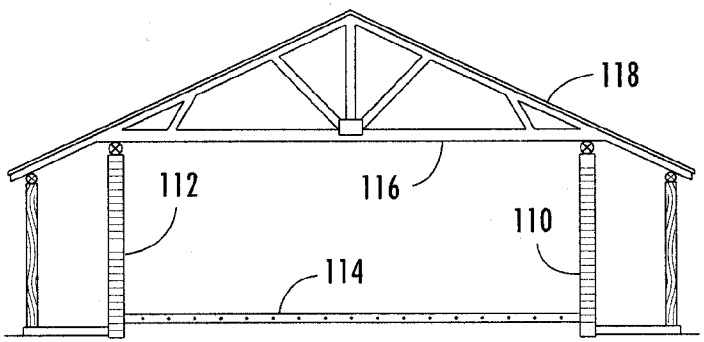
FIG. 5 is a cross sectional side view of a building section.
Figure 6:
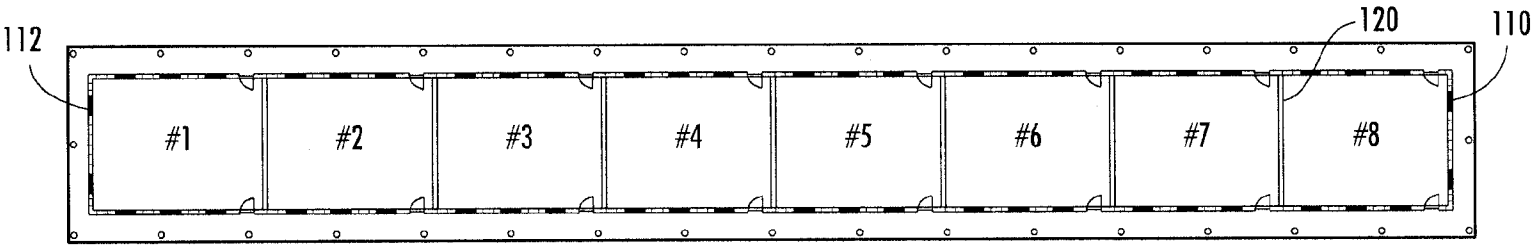
FIG. 6 is a top view of a building structure using the construction blocks of the instant invention.
Figure 7:
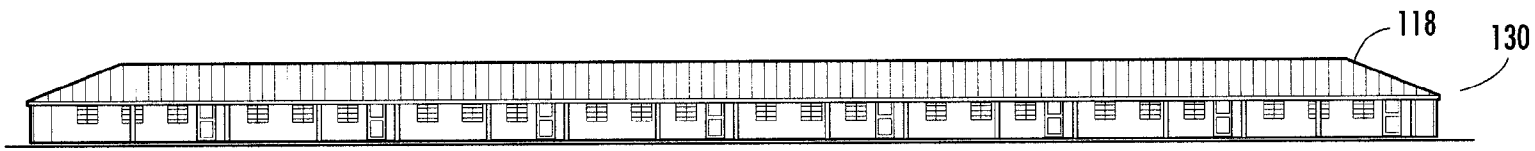
FIG. 7 is a front elevation view of the building structure of FIG. 6.

As shown in FIGS. 5-7, the construction blocks (110 and 112) are used in the construction of buildings to create a vertical wall in a similar manner to a cinderblock construction. Depending on the use, a floor (114) can be placed between the walls. It is noted that a foundation is not necessary for the walls. Shown is a cross sectional wall drawing having a wall with a height of 21 stacked blocks. Conventional wood trusses (116) are used for support of the roof (118). Further, as shown in FIG. 6, the construction blocks can be used to an entire structure with either divider walls made from the blocks or by use of drywall dividers (120). As previously noted, drywall can be hung from the construction blocks to provide a conventional-looking interior. It should also be noted that a filled construction block provides an R-9 rating factor for energy and sound deadening. FIG. 7 depicts the front elevation of the structure (130) for use in the Kwazulu Natal Community School in Mkuze, South Africa. Doors (132) and windows (134) can be placed into the structure in a similar manner as those screwed into wood frames. It should be noted that the structure is receptive to the use of conventional screws for attachment, obviously screws used for thin wall holding including molly bolts will provide enhanced securement.

All patents and publications mentioned in this specification are indicative of the levels of those skilled in the art to which the invention pertains.

All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A construction block comprising: a plastic structure having a top surface, a bottom surface, a front surface, a rear surface, and opposing side surfaces forming a hollow interior, said top surface having a fill port opening allowing access to said hollow interior; a cap releasably secured to said fill port opening; a first aperture extending from said front surface to said rear surface; a second aperture extending from said front surface to said rear surface; said front surface having a raised protrusion placed about each said first and second aperture; said rear surface having a receptacle placed about each said first and said second aperture, said raised protrusion on said front surface interlocking with a receptacle on a rear surface of an adjoining construction block for aligning similar shaped construction blocks, each said aperture is further defined as a first frustoconical portion and a second frustoconical portion, both frustoconical portions having a wide opening and a narrow opening, said wide opening of said first frustoconical portion being disposed about said front surface, said wide opening of said second frustoconical portion being disposed about said rear surface, said frustoconical portions being joined together at the narrow openings by an annular tube;

at least one anchoring pipe having a length and a diameter;

said front surface includes at least two anchoring pipe retaining sockets for temporary receipt of said at least one anchoring pipe, said retaining sockets having a depth of about one half the diameter of said at least one anchoring pipe and a width about as long as said at least one anchoring pipe length, said at least two anchoring pipe retaining sockets being substantially parallel to each other, one of each said at least two anchoring pipe retaining sockets extending along said front adjacent said side surface;

said rear surface includes at least two reciprocal anchoring pipe retaining sockets, each said at least two reciprocal anchoring pipe retaining sockets having a depth of approximately one half the diameter of said anchoring pipe, said at least two anchoring pipe retaining sockets on said rear surface being substantially parallel to each other, one of each said at least two anchoring pipe retaining sockets on said rear surface extending along said front adjacent said side surface, each of said at least two reciprocal retaining sockets on said rear surface nesting with said at least one anchoring pipe of an adjoining construction block for storage and shipping;

a centrally located cut line encompassing said front, said rear, and both said side surfaces of said construction block, wherein said cut line allows for ease of cutting the construction block into equal halves;

wherein said construction block is capable of storing fluids, food, and staples for ease of shipping whereby said construction block can be reused to hold earth materials to allow for structure formation, said anchoring pipe available to place through said aperture to interconnect said construction block with at least one adjacent construction block.

2. The construction block according to claim 1 wherein each said protrusion includes at least one groove extending perpendicular to said aperture allowing ease of material displacement during abutment with a receptacle.

3. The construction block according to claim 1 wherein each said aperture extends through said raised protrusion on said front surface to said receptacle on said rear surface.

4. The construction block according to claim 1 wherein said wide opening of said frustoconical portion is about 0.75 inches in diameter.

5. The construction block according to claim 1 wherein said protrusions are formed integral to said structure.

6. The construction block according to claim 1 wherein each said side wall includes a centrally located tapered detent disposed in the middle of said structure, said tapered detent allowing for the self-centering of a saw blade.

7. The construction block according to claim 1 wherein said structure is formed from HDPE meeting U.S. Food & Drug Administration food grade standards.

8. A construction block comprising: a plastic structure having a top surface, a bottom surface, a front surface, a rear surface, and opposing side surfaces for a hollow interior, said top surface having a fill port opening allowing access to said hollow interior; a cap releasably secured to said fill port opening; a first aperture extending from said front surface to said rear surface;

a second aperture extending from said front surface to said rear surface; said front surface having a raised protrusion formed integral with and placed about each said first and said second aperture;

said rear surface having a receptacle placed about each said first and said second aperture, each said aperture extends through said raised protrusion on said front surface to said receptacle on said rear surface; said raised protrusion on said front surface interlocking with a receptacle on a rear surface of an adjoining construction block for aligning similar shaped construction blocks, each said aperture having a first frustoconical portion and a second frustoconical portion, both frustoconical portions having a wide opening and a narrow opening, said wide opening of said first frustoconical portion being disposed about said front surface, said wide opening of said second frustoconical portion being disposed about said rear surface, said frustoconical portions being joined together at the narrow openings by an annular tube;

at least one anchoring pipe having a length and a diameter;

said front surface includes at least two anchoring pipe retaining sockets for temporary receipt of said at least one anchoring pipe, said retaining sockets having a depth of about one half the diameter of said at least one anchoring pipe and a width about as long as said at least one anchoring pipe length, said at least two anchoring pipe retaining sockets being substantially parallel to each other, one of each said at least two anchoring pipe retaining sockets extending along said front adjacent said side surface;

said rear surface includes at least two reciprocal anchoring pipe retaining sockets, each said at least two reciprocal anchoring pipe retaining sockets having a depth of approximately one half the diameter of said anchoring pipe, each said reciprocal retaining sockets nesting with at least one anchoring pipe of an adjoining construction block for storage and shipping;

a centrally located cut line encompassing said front, said rear, and both said side surfaces of said construction block, wherein said cut line allows for ease of cutting the construction block into equal halves;

wherein said construction block is capable of storing fluids, food, and staples for ease of shipping whereby said construction block can be reused to hold earth materials to allow for structure formation, said anchoring pipe available to place through said aperture to interconnect said construction block with at least one adjacent construction block.

9. The construction block according to claim 8 wherein each said protrusion includes at least one groove extending perpendicular to said aperture allowing ease of material displacement during abutment with a receptacle.

10. The construction block according to claim 8 wherein said wide opening of said frustoconical portion is about 0.75 inches in diameter.

11. The construction block according to claim 8 wherein each said side wall includes a centrally located tapered detent dispose in the middle of said structure, said tapered detent allowing for the self-centering of a saw blade.

12. The construction block according to claim 8 wherein said structure is formed from HDPE meeting U.S. Food & Drug Administration food grade standards.

* * * * *